US007281594B2

(12) United States Patent
Hadin

(10) Patent No.: US 7,281,594 B2
(45) Date of Patent: Oct. 16, 2007

(54) ROCK DRILL BIT

(75) Inventor: Per-Ola Hadin, Järbo (SE)

(73) Assignee: Sandvik Intellectual Property AB, Sandviken (SE)

( * ) Notice: Subject to any disclaimer, the term of this patent is extended or adjusted under 35 U.S.C. 154(b) by 141 days.

(21) Appl. No.: 11/274,484

(22) Filed: Nov. 16, 2005

(65) Prior Publication Data

US 2006/0162965 A1 Jul. 27, 2006

(30) Foreign Application Priority Data

Nov. 17, 2004 (SE) ..... 0402806

(51) Int. Cl.
*E21B 10/36* (2006.01)

(52) U.S. Cl. ..... 175/320; 175/414

(58) Field of Classification Search ..... 175/296, 175/417, 414, 320

See application file for complete search history.

(56) References Cited

U.S. PATENT DOCUMENTS

| | | | | |
|---|---|---|---|---|
| 3,357,507 A | | 12/1967 | Stewart | |
| 3,955,635 A | | 5/1976 | Skidmore | |
| 4,598,779 A | | 7/1986 | Liljekvist et al. | 175/410 |
| 4,862,976 A | * | 9/1989 | Meek | 175/296 |
| 5,743,345 A | * | 4/1998 | Hollar et al. | 175/401 |
| 5,794,728 A | | 8/1998 | Palmberg | 175/400 |
| 5,890,551 A | | 4/1999 | Liljebrand et al. | 175/418 |
| 6,494,275 B2 | | 12/2002 | Asberg et al. | 175/401 |
| 6,971,458 B2 | | 12/2005 | Kriesels et al. | |
| 7,207,402 B2 | | 4/2007 | Bjork | |
| 2001/0018990 A1 | | 9/2001 | Asberg et al. | 175/384 |
| 2003/0230433 A1 | * | 12/2003 | Hedlund et al. | 175/320 |
| 2004/0065482 A1 | * | 4/2004 | Larsson | 175/414 |
| 2005/0072602 A1 | * | 4/2005 | Pascale et al. | 175/414 |
| 2006/0060389 A1 | | 3/2006 | Hadin et al. | |
| 2006/0213691 A1 | * | 9/2006 | Barton et al. | 175/325.5 |
| 2006/0249309 A1 | * | 11/2006 | Cruz | 175/57 |

FOREIGN PATENT DOCUMENTS

| | | | |
|---|---|---|---|
| SE | 520036 | | 5/2003 |
| WO | WO 2005056972 A1 | * | 6/2005 |
| WO | WO 2006/033606 A1 | | 3/2006 |
| WO | WO 2006/054933 A1 | | 5/2006 |

* cited by examiner

*Primary Examiner*—David Bagnell
*Assistant Examiner*—Daniel P Stephenson
(74) *Attorney, Agent, or Firm*—Drinker Biddle & Reath LLP

(57) ABSTRACT

The present invention relates to a rock drill bit for percussive drilling. The drill bit comprises a bit body, a head portion defining a longitudinal center axis. The head portion includes an axially forward rock-crushing surface and a skirt that extends axially rearwardly from the rock-crushing surface. The rock-crushing surface comprises several rock-crushing means. A circumferential outer surface of the skirt is provided with circumferentially spaced apart grooves forming lands therebetween. The grooves and the lands extend generally in an axial direction. An axially rearward portion of a land is provided with a guiding surface. The guiding surface faces radially outwardly. The guiding surface comprises at least one step or a sloping surface such to reduce the diametrical dimension stepwise or continuously, respectively. The guiding surface comprises a first guiding portion and a second guiding portion both situated radially outside of an imaginary extension line of the waist. The first guiding portion projects farther radially outwardly than the second guiding portion relative to the center axis of the drill bit.

26 Claims, 4 Drawing Sheets

ROCK DRILL BIT

TECHNICAL FIELD OF THE INVENTION

The present invention relates to a rock drill bit for percussive drilling, especially top hammer drilling, according to the preamble of the independent claim.

Through U.S. Pat. No. 5,890,551 a rock drill bit is previously known, which has an appurtenant drill rod. The rock drill bit at the front face thereof is provided with cemented carbide buttons that work the rock by impacting thereupon during simultaneous rotation. A cavity is formed in the front face, and a fluid channel extends through the drill bit for supplying flushing fluid to the cavity. The cavity is completely bordered by an endless land. Some of the buttons are mounted in the land. Others of the buttons are mounted in the cavity in order to be cooled and flushed by a cushion of flushing fluid created in the cavity. U.S. Pat. No. 4,598,779 shows another rock drill bit of the percussive type for drilling straight holes. U.S. Pat. No. 6,494,275 discloses a rock drill bit for percussive drilling. The rock drill bit includes a bit head provided with front rock crushing buttons and a skirt. The bit head is provided with a number of grooves formed in the outside of the skirt and extending in the axial direction of the drill bit. Protruding lands are defined between the grooves, which likewise extend in the axial direction. Axially rearward ends of the lands are provided with projecting, part-cylindrical guiding surfaces.

OBJECTS OF THE INVENTION

The present invention has the object of providing a rock drill bit of the kind defined in the introduction, with extended service life.

Another object of the present invention is to provide a rock drill bit for producing straight holes.

Still another object of the present invention is to provide a rock drill bit that permits good rock removal.

The objects of the present invention are realized by means of a rock drill bit having the features defined in the characterizing portions of the appended independent claims.

BRIEF DESCRIPTION OF THE DRAWINGS

An embodiment of the rock drill bit according to the present invention will be described below, reference being had to the accompanying drawings, wherein.

DETAILED DESCRIPTION OF A PREFERRED EMBODIMENT OF A ROCK DRILL BIT ACCORDING TO THE PRESENT INVENTION

Figure 2C:
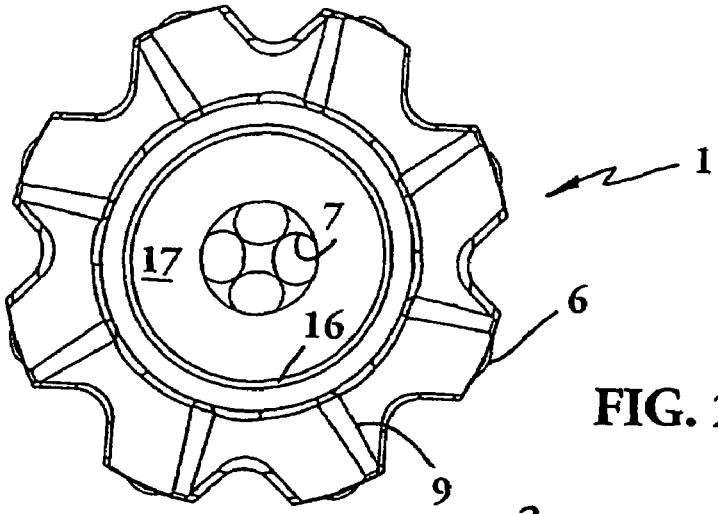
FIG. 2C shows a rear end view of the rock drill bit shown in FIG. 1A.
Figure 1A:
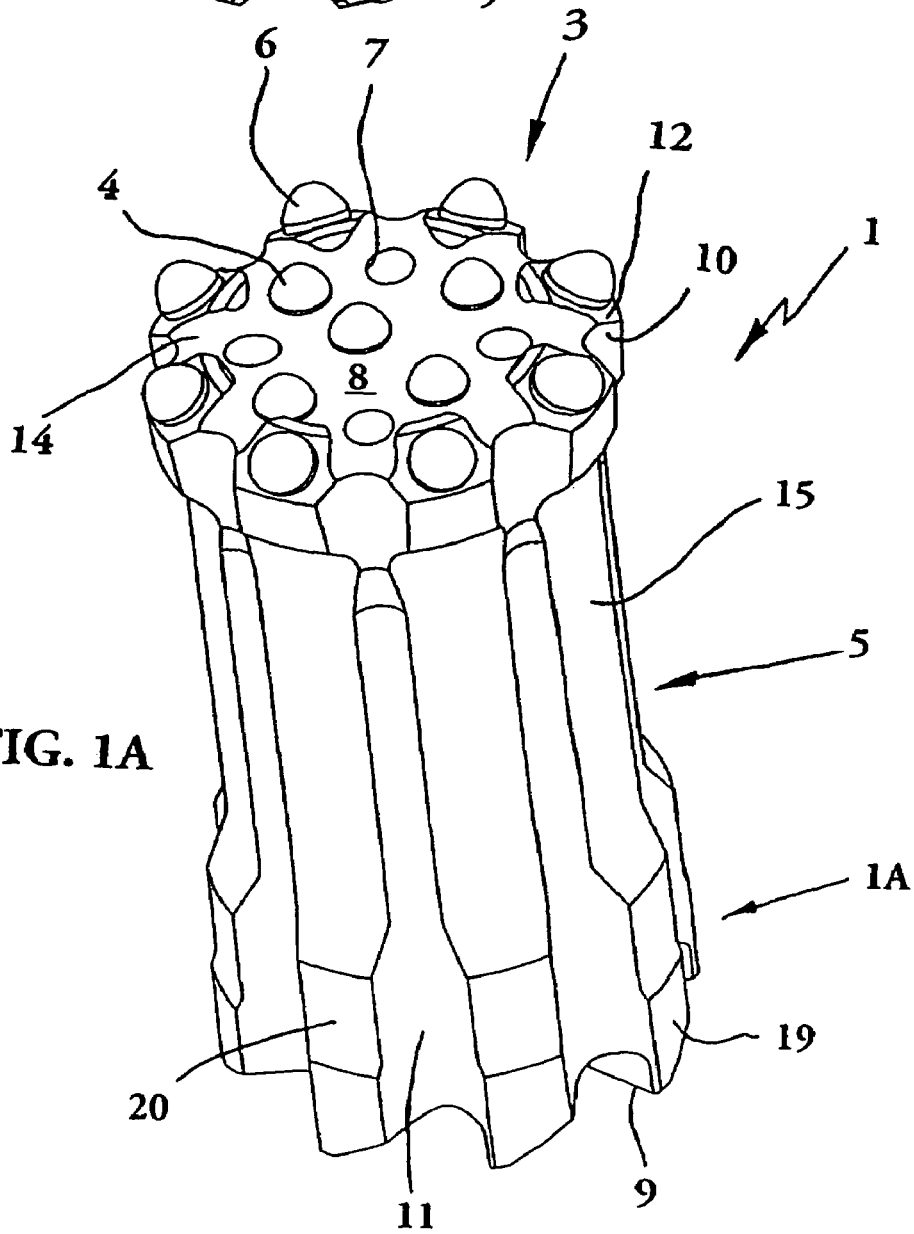
FIG. 1A shows a perspective front view of a rock drill bit according to the present invention.
Figure 1D:
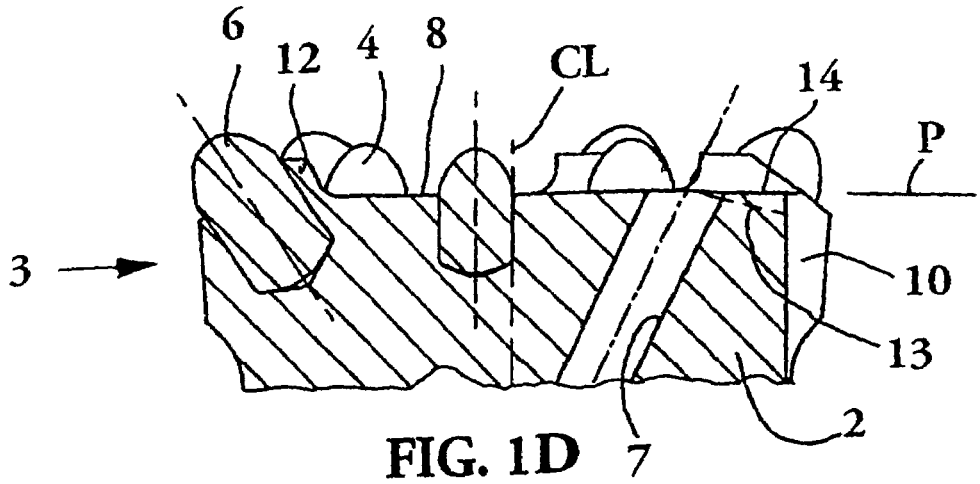
FIG. 1D shows a cross-section through the rock drill bit according to line D-D in FIG. 1B.
Figure 1B:
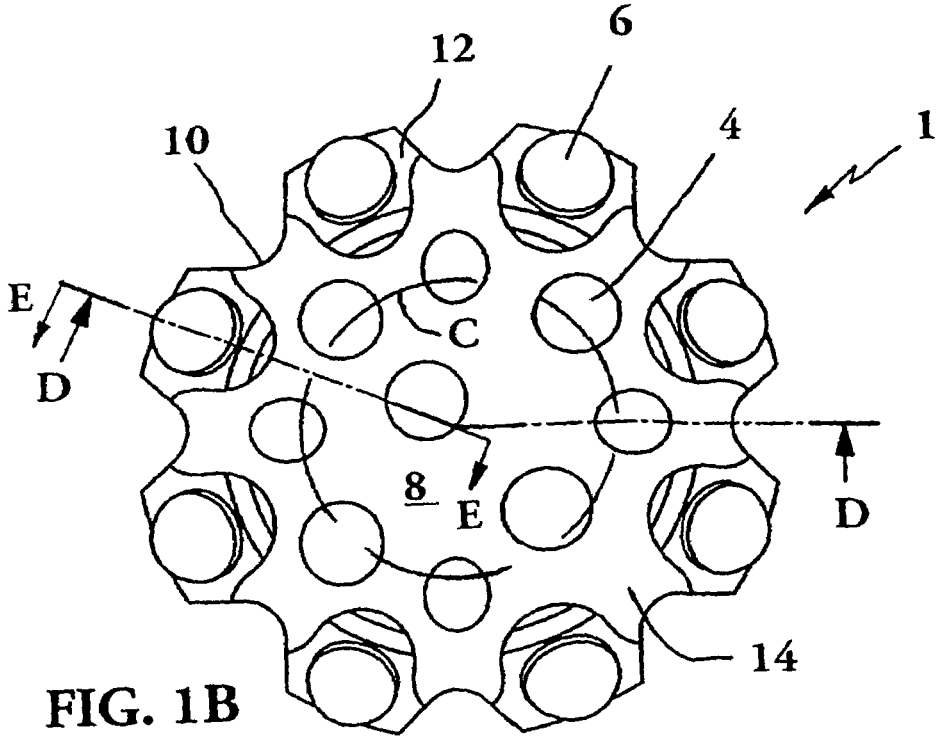
FIG. 1B shows a front end view of the rock drill bit.
Figure 1C:
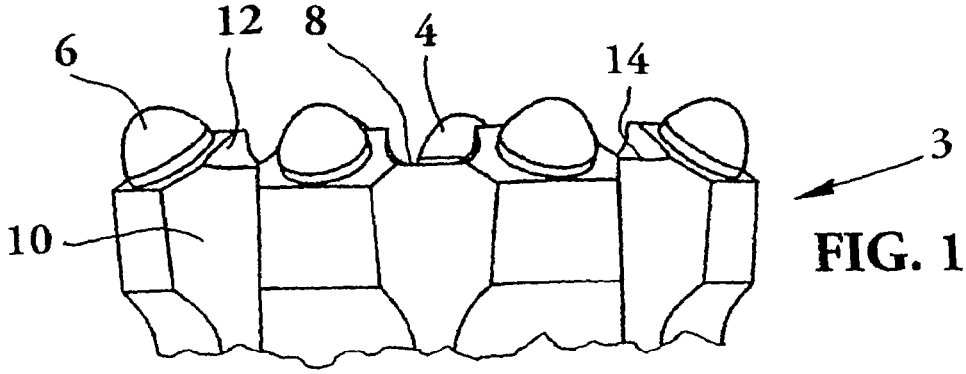
FIG. 1C shows a side view of a front portion of the rock drill bit.
Figure 2A:
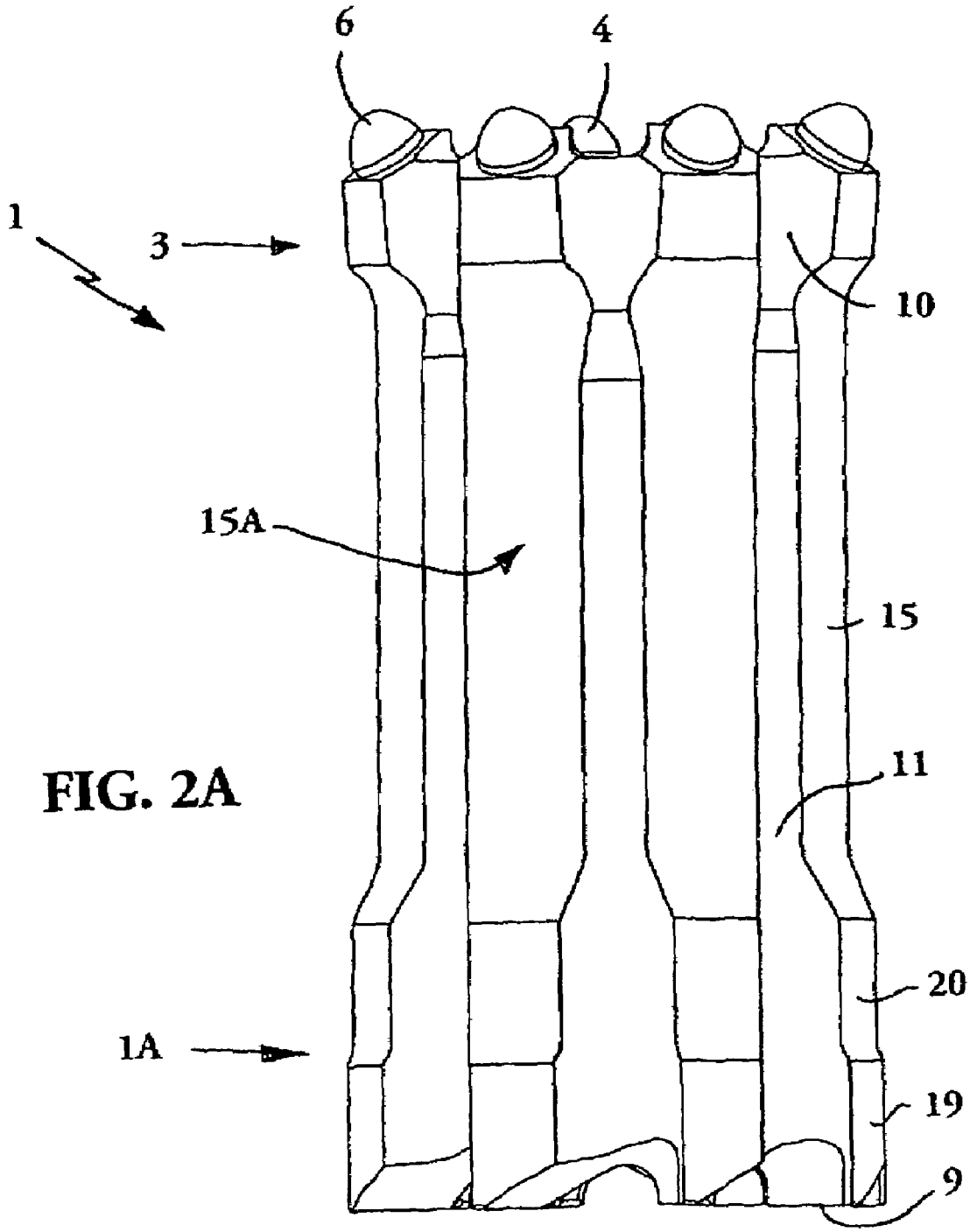
FIG. 2A shows a side view of the rock drill bit shown in FIG. 1A.
Figure 2B:
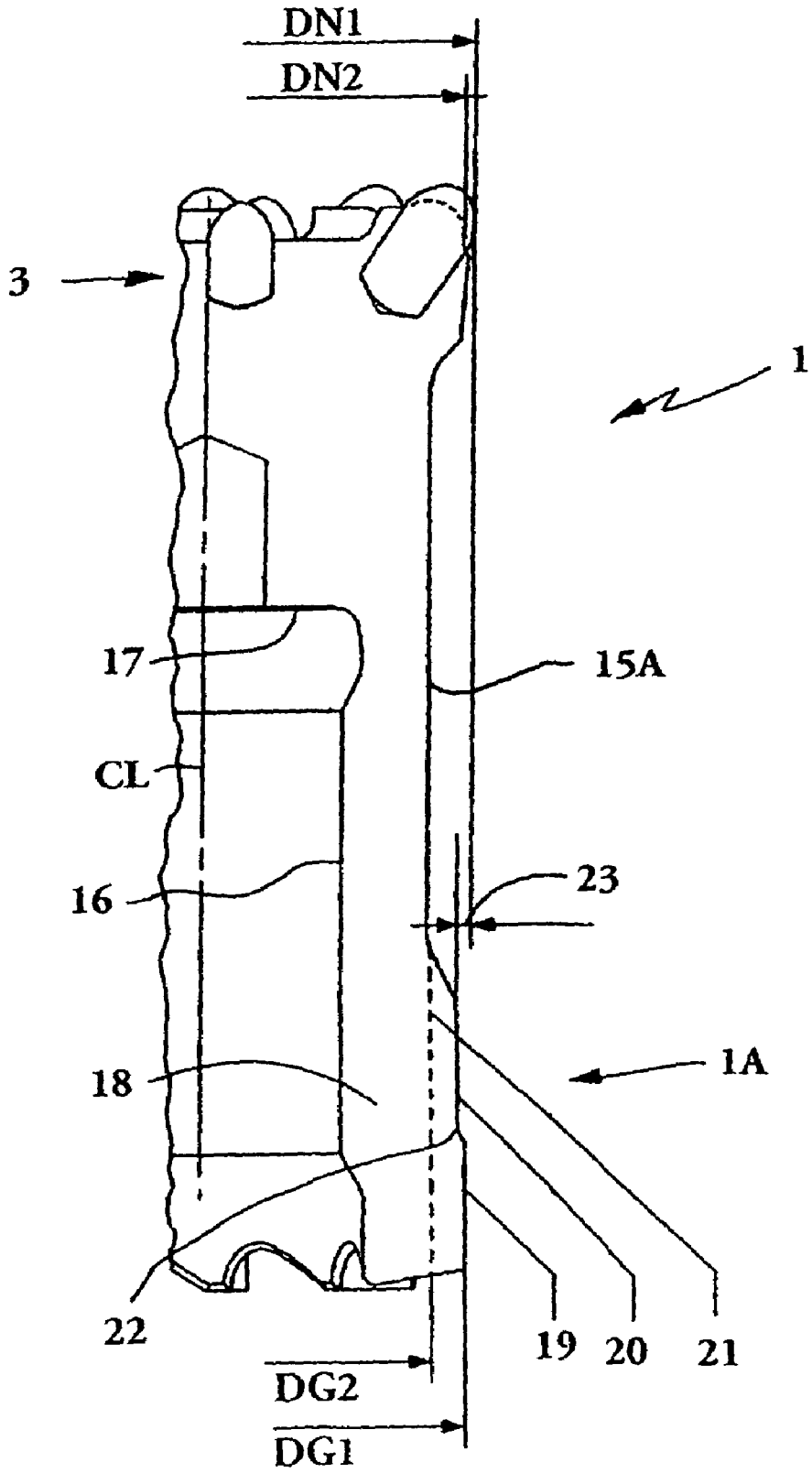
FIG. 2B shows a cross-section through the rock drill bit according to the line E-E in FIG. 1B.

The percussion rock drill bit 1 illustrated in FIGS. 1A-1D and 2A-2C comprises a bit body 2 having a head portion or a drill head 3 and a shank or a skirt 5. The drill head 3 and the skirt 5 are rigidly integrated with each other. A drill rod, not shown, is supposed to be connected to the rock drill bit 1 via a thread coupling. In the drill rod, a through-going flush duct is arranged in the conventional way. A longitudinal center axis CL of the rock drill bit 1 is shown in FIGS. 1D and 2B. The rock drill bit 1 is provided with an internal female thread 16 supposed to receive an external male thread at one end of an elongate drill element such as a rod or tube, not shown.

The drill head 3 of the rock drill bit 1 according to the present invention is provided with rock removing members preferably in the form of cemented carbide buttons, e.g. front buttons 4 and peripheral buttons 6. Alternatively, the rock removing members may be constituted of chisel inserts. At least one cooling medium channel 7 extends between an internal space of the rock drill bit 1, which is defined between the internal female thread 16, and a front face or rock-crushing surface 8 of the drill head 3. The front face 8 defines a plane P that is substantially perpendicular to the center axis CL. In said internal space, a first stop face 17, a so-called bottom stop, is preferably arranged for the free end of the drill rod. A number of retrac edges 9 is preferably arranged at the rear end of the rock drill bit 1.

As is most clearly seen in FIGS. 1A and 2A the rock drill bit 1 is provide with a number of substantially straight, external front 10 and rear 11 grooves for cuttings extending in the axial direction of the rock drill bit 1. Each front groove 10 connects to an associated rear groove 11 to provide a groove for cuttings that extend along the entire length of the drill bit 1. Each front groove 10 for cuttings is symmetrically arranged in relation to a line parallel with the center axis CL. The front grooves 10 are provided between each pair of peripheral buttons 6 in the bit body. Eight peripheral buttons 6 are mounted in the drill head 3 although there could alternatively be arranged any of 5 to 10 buttons in another drill bit according to the present invention. Each peripheral button 6 is tilted outwardly relative to the center axis CL to define the maximum diameter of the drill bit. The diameter of a peripheral button 6 is preferably greater than the diameter of a front button 4. Each peripheral button 6 is arranged in a steel segment or raised portion 12 at least partially projecting relative to the plane P in the axial direction of the drill bit. Each raised portion is integrated with the body 2 and generally directed forwardly, i.e. in the working feed direction of the drill bit. A hole, not shown, is formed in the raised portion to receive one peripheral button 6. Alternatively, there can be two peripheral buttons positioned in each raised portion. Each raised portion 12 is spaced in the wreath or outer portion of peripheral buttons from another adjacent raised portion by the front face 8 or by an additional front groove 13 (as depicted by the dashed line in FIG. 1D). The outer portion comprises a number of circumferentially spaced, raised portions 12 equal to the number of peripheral buttons 6, i.e. each raised portion 12 carries one peripheral button 6. Each peripheral button 6 projects axially forwardly beyond all front buttons 4. The common planar, axially foremost level of the front buttons 4 is spaced rearwardly in relation to the common planar, axially foremost level of the surrounding peripheral buttons 6. Thereby, a greater guiding moment is achieved by raising the wreath of peripheral buttons 6 above the front face 8 and the front buttons 4. The raised portions 12 are spaced by a radial passage or part 14 of the front face 8 to allow an unobstructed flow of flushing medium therebetween.

The peripheral buttons 6 are mounted in the drill head 3 radially outside of an imaginary circle C intersecting at least two front buttons 4 and at least two flushing channels 7 arranged generally annularly around the center axis CL of the drill bit 1. The front buttons 12 are mounted in the front face 8 radially inside of the peripheral buttons 6. Orifices of the fluid channels 7 are arranged in the plane P below the raised portions 12. The raised portions 12 are arranged radially outside of an imaginary circle C intersecting four or at least two front buttons 4 and four or at least two flushing channels 7 arranged generally annularly around the center axis CL of the drill bit 1. The front face 8 ends at the peripheral grooves 10 in the bit body 2. The imaginary circle C intersecting the fluid channels 7 also intersects an equal number of front buttons 4. Major parts of the peripheral buttons 6, which usually are 5 to 10 pieces, are mounted in the front is face 8 radially outside of the circle C. The additional front groove is formed between each peripheral groove 10 and the front face 8. The front groove is a bevel 13 sloping outwardly relative to the longitudinal center axis CL and rearwardly relative to the front face. The front groove may alternatively follow a curve that is generally sloping outwardly and rearwardly in relation to CL. In practice all buttons are advantageously made of cemented carbide, possibly diamond-enhanced. The shape of the buttons can be spherical, conical, ballistic, semi-ballistic or chisel shaped.

The rear end of the drill bit comprises retrac teeth 9 that are positioned at the maximum diameter of the drill bit, and extending radially inwards therefrom, at the end generally facing away from the rock removing end of the rock drill bit. The purpose of the rear end of the drill bit is to make sure that guiding of the drill bit 1 in the bore hole is carried out by means of the portions that are located in connection with the ends of the rock drill bit 1, and to decrease the resistance against the release of cutting dust. The grooves for cuttings 10, 11 are intended to transport away the drill dust produced at the front of the rock drill bit 1. A circumferential outer surface of the skirt is formed with circumferentially spaced apart grooves 11 forming lands 15 therebetween. The drill bit 1 has a waist 15A at its mid portion. The dimension of the waist 15A is smaller than the diameter of the rear portion 1A at which the drill bit is guided. The waist 15A may comprise the grooves 11 or be substantially smooth, such as a cylindrical shape. The grooves and the lands extend generally in the axial direction. An axially rearward portion of at least one land 15 is provided with a guiding surface that faces radially outwardly. The guiding surface comprises a first guiding portion 19 and a second guiding portion 20 both situated radially outside of an imaginary extension line 21 of the waist 15A. The first guiding portion 19 projects farther radially outwardly than the second guiding portion 20 relative to the center axis CL of the drill bit. Each guiding portion 19, 20 is of part-cylindrical shape. The first guiding portions 19 are defined by a first diameter DG1 and the second guiding portions 20 are defined by a second diameter DG2. The diameter of the head portion 3 is 3-6%, preferably about 4%, larger than the diameter of the first diameter DG1 of the first guiding portions 19. Extension lines of the guiding portions 19, 20 intersect a peripheral button 6.

The guiding diameter on the guide or rear portion 1A is worn more on prior art drill bits (e.g. U.S. Pat. No. 6,494,275), that is said bits obtain a greater gap between the nominal diameter DN1 and the original first diameter DG1 of the guiding portion than a drill bit according to the present invention. The gap 23 between the nominal diameter DN1 and the original first diameter DG1 of the guiding portion in a drill bit 1 according to the present invention is preferably greater than 2.5 mm but preferably less than 4 mm, more preferably about 3 mm.

The configuration of the guide portion 1A of the drill bit according to the present invention allows the button shape to be maintained for a longer period of time of drilling and this explains why the drill bits according to the present invention are easier to regrind and that life-span increases and that it drills straighter. At drill bits according to a preferred embodiment of a drill bit according to the present invention all eight lands become guiding surfaces and this can is described as a circle. This gives advantages with regard to hole straightness, tool life and simplicity to regrind.

The guiding portions 19, 20 are provided in steps radially outside of the land 15. Each portion has an axial length that is 20-30 mm long. The number of guiding portions can be two or more in order to optimize the wear and keep a correct gap between nominal diameter DN1, DN2 (as illustrated in FIG. 2B) and the diameter DG1 and DG2, respectively at the rear portion 1A of the drill bit according to the present invention. DN1 depicts the nominal diameter at the drill bit head portion 3, that is maximum diameter defined by the radially outer portions of the peripheral buttons 6. DN2 depicts the diameter of the drill bit head portion when the buttons 6 have been reground. DG1 depicts as noted the first diameter at the drill bit rear portion 1A, that is the maximum diameter defined by the radially outer portions of the first guiding portions 19. DG2 depicts as noted the second diameter at the drill bit rear portion 1A, that is the maximum diameter defined by the radially outer portions of the first guiding portions 20. The diameter formed by the lands 15 is less than both DG1 and DG2. The step 22 bridging the guiding portions 19 and 20 is 2 to 3 mm in height in the radial direction of the drill bit to allow for a balanced wear. This extra "tight" guide portion provides a drill bit that drills straighter hole during its life. Alternatively, instead of steps 22 a preferably convex or conical, sloping surface an be provided such to reduce the diametrical dimension continuously axially forwardly towards the head portion 3 from the first diameter DG1 to the diameter of the waist 15A.

Preferably, the drill head is machined or milled to produce a front face 8 and the raised portions 12. Milling tests have shown that the time for milling the front of the drill bit according to the present invention can be reduced by about 20% as compared to conventional drill bits.

The drill bit according to the present invention has numerous advantages. The drill bit easier to regrind and the life-span increases and it drills straighter. An additional advantage is that the stepped configuration of the drill bit according to the present invention allows a smaller stock of drill bits since the stepped configuration can be used in bits for both hard and loose rock.

In a preferred embodiment of a drill bit according to the present invention the front face 8 is relatively "open" such that the flushing medium (air and/or water) will not be obstructed from flowing between the raised portions 12.

This means that flushing of the front surface 8 will be efficient. By having the peripheral buttons projecting farther than the front buttons a guiding rock center will develop during drilling such that even straighter holes can be achieved. The relative symmetry of the front surface makes the front face 8 suitable for drill bits for both left hand and right hand drilling which is the case at top hammer and down-the-hole drilling, respectively. Furthermore, the time for machining the front of the drill bit according to the present invention can be reduced.

The drill bit according to the present invention gives at least the following advantages as compared to prior art drill bits: the life of the drill bit is extended and it drills straighter holes.

The invention claimed is:

1. A rock drill bit adapted for percussive drilling, the drill bit comprising: a bit body and a head portion defining a longitudinal center axis, the head portion including an axially forward rock-crushing surface and a skirt extending axially rearwardly from the rock-crushing surface, said rock-crushing surface comprising several rock-crushing means, a circumferential outer surface of the skirt being formed with circumferentially spaced apart grooves forming lands therebetween, the grooves and the lands extending generally in an axial direction, an axially rearward portion of a land is provided with a guiding surface, said guiding surface facing radially outwardly, said drill bit having a waist at its mid portion, wherein the guiding surface comprises at least one step or a sloping surface such to reduce the diametrical dimension stepwise or continuously, respectively, wherein the guiding surface comprises a first guiding portion and a second guiding portion both situated radially outside of an imaginary extension line of the waist, wherein the first guiding portion projects farther radially outwardly than the second guiding portion relative to the center axis of the drill bit, and wherein each guiding portion is of part-cylindrical shape and wherein the first guiding portions are defined by a first diameter and wherein the second guiding portions are defined by a second diameter.

2. The drill bit according to claim 1, wherein a nominal diameter of the drill bit is 3-6% larger than the diameter of first diameter of the first guiding portions.

3. The drill bit according to claim 2, wherein the nominal diameter of the drill bit is about 4% larger than the diameter of the first diameter of the first guiding portions.

4. The drill bit according to claim 2, wherein an axial rear portion of at least some of the lands forms a retrac tooth for crushing rock during withdrawal of the bit from a hole and wherein at least one fluid channel extends through the head portion and communicating with the front face for conducting a flushing medium thereto.

5. The drill bit according to claim 2, wherein the head portion comprises an outer portion, said outer portion comprises a number of circumferentially spaced, raised steel portions, each said portion comprising maximum two peripheral buttons.

6. The drill bit according to claim 5, wherein each raised portion carries at least one peripheral button and wherein extension lines of the guiding portions intersect a peripheral button.

7. The drill bit according to claim 6, wherein the raised portions are spaced by a radial passage of the front face to allow an unobstructed flow of flushing medium therebetween.

8. The drill bit according to claim 2, wherein the front face ends at peripheral grooves in the bit body.

9. The drill bit according to claim 8, wherein an additional front groove is formed between each peripheral groove and the front face, said front groove generally sloping outwardly and rearwardly.

10. The drill bit according to claim 1, wherein an axial rear portion of at least some of the lands forms a retrac tooth for crushing rock during withdrawal of the bit from a hole and wherein at least one fluid channel extends through the head portion and communicating with the front face for conducting a flushing medium thereto.

11. The drill bit according to claim 10, wherein the head portion comprises an outer portion, said outer portion comprises a number of circumferentially spaced, raised steel portions, each said portion comprising maximum two peripheral buttons.

12. The drill bit according to claim 11, wherein each raised portion carries at least one peripheral button and wherein extension lines of the guiding portions intersect a peripheral button.

13. The drill bit according to claim 12, wherein the raised portions are spaced by a radial passage of the front face to allow an unobstructed flow of flushing medium therebetween.

14. The drill bit according to claim 10, wherein the front face ends at peripheral grooves in the bit body.

15. The drill bit according to claim 14, wherein an additional front groove is formed between each peripheral groove and the front face, said front groove generally sloping outwardly and rearwardly.

16. The drill bit according to claim 1, wherein the head portion comprises an outer portion, said outer portion comprises a number of circumferentially spaced, raised steel portions, each said portion comprising maximum two peripheral buttons.

17. The drill bit according to claim 16, wherein each raised portion carries at least one peripheral button and wherein extension lines of the guiding portions intersect a peripheral button.

18. The drill bit according to claim 17, wherein the raised portions are spaced by a radial passage of the front face to allow an unobstructed flow of flushing medium therebetween.

19. The drill bit according to claim 18, wherein the front face ends at peripheral grooves in the bit body.

20. The drill bit according to claim 19, wherein an additional front groove is formed between each peripheral groove and the front face, said front groove generally sloping outwardly and rearwardly.

21. The drill bit according to claim 16, wherein the front face ends at peripheral grooves in the bit body.

22. The drill bit according to claim 21, wherein an additional front groove is formed between each peripheral groove and the front face, said front groove generally sloping outwardly and rearwardly.

23. The drill bit according to claim 1, wherein the front face ends at peripheral grooves in the bit body.

24. The drill bit according to claim 23, wherein an additional front groove is formed between each peripheral groove and the front face, said front groove generally sloping outwardly and rearwardly.

25. The drill bit according to claim 1, wherein an axial rear portion of at least some of the lands forms a retrac tooth for crushing rock during withdrawal of the bit from a hole.

26. The drill bit according to claim 1, wherein at least one fluid channel extends through the head portion and communicating with the front face for conducting a flushing medium thereto.

* * * * *